US006708455B1

(12) United States Patent
Niiduma

(10) Patent No.: US 6,708,455 B1
(45) Date of Patent: Mar. 23, 2004

(54) POLYHEDRAL FABRICATED STRUCTURE AND METHOD OF CONSTRUCTING THE SAME

(75) Inventor: Yoshimi Niiduma, Tokyo (JP)

(73) Assignee: Housing Kousan Co., Ltd., Tokyo (JP)

( * ) Notice: Subject to any disclaimer, the term of this patent is extended or adjusted under 35 U.S.C. 154(b) by 0 days.

(21) Appl. No.: 09/868,238

(22) PCT Filed: Dec. 28, 1999

(86) PCT No.: PCT/JP99/07403

§ 371 (c)(1),
(2), (4) Date: Jun. 15, 2001

(87) PCT Pub. No.: WO00/39415

PCT Pub. Date: Jul. 6, 2000

(30) Foreign Application Priority Data

Dec. 28, 1998 (JP) ..... 10-373944

(51) Int. Cl.[7] ..... E04B 7/00

(52) U.S. Cl. ..... 52/81.2; 52/81.3; 52/745.07; 52/653.2; 403/176; 403/218

(58) Field of Search ..... 52/81.1, 81.2, 52/81.3, 80.1, 80.2, 638, 651.11, 652.1, 653.2, 655.1, 655.2, 656.9, 730.4, 732.1, 731.2, 737.6, 745.07, 745.08; 403/171, 176, 217, 218

(56) References Cited

U.S. PATENT DOCUMENTS

| | | | | | |
|---|---|---|---|---|---|
| 2,545,556 | A | * | 3/1951 | Pont | 135/123 |
| 3,002,590 | A | * | 10/1961 | Hannoosh et al. | 52/81.2 |
| 3,040,849 | A | * | 6/1962 | Abberly | 138/116 |
| 3,137,371 | A | * | 6/1964 | Nye | 482/36 |
| 3,766,573 | A | * | 10/1973 | Burkholz et al. | 4/498 |
| 4,068,422 | A | * | 1/1978 | Sumner | 52/745.07 |
| 4,092,809 | A | * | 6/1978 | Bellas et al. | 52/63 |
| 4,449,843 | A | * | 5/1984 | Wendel | 403/173 |
| 4,491,437 | A | * | 1/1985 | Schwartz | 403/172 |
| 4,555,878 | A | * | 12/1985 | Tringali | 52/81.1 |
| 4,570,408 | A | * | 2/1986 | Frascaroli et al. | 52/726.2 |
| 4,608,789 | A | * | 9/1986 | Willis | 52/81.1 |
| 4,833,843 | A | * | 5/1989 | Richter | 52/745.07 |
| 5,937,589 | A | * | 8/1999 | Fischer | 52/81.3 |
| 6,101,769 | A | * | 8/2000 | Hamill | 52/167.1 |
| 6,295,785 | B1 | * | 10/2001 | Herrmann | 52/639 |
| 6,460,309 | B1 | * | 10/2002 | Schneider | 52/729.1 |

FOREIGN PATENT DOCUMENTS

| | | | | |
|---|---|---|---|---|
| EP | 64176 | A * | 11/1982 | 52/81.1 |
| FR | 2603927 | A * | 3/1988 | 52/80.2 |
| JP | 63-226426 | | 9/1988 | |
| JP | 2-176035 | | 7/1990 | |
| JP | 4-176930 | | 6/1992 | |
| JP | 3004346 | | 11/1994 | |
| JP | 3004347 | | 11/1994 | |
| JP | 3012866 | | 6/1995 | |
| JP | 9-125521 | | 5/1997 | |
| SU | 1183634 | A * | 10/1985 | 52/81.1 |
| SU | 1245673 | A * | 7/1986 | 52/81.1 |
| WO | 92/04510 | | 3/1992 | |

* cited by examiner

*Primary Examiner*—Carl D. Friedman
*Assistant Examiner*—Brian E. Glessner
(74) *Attorney, Agent, or Firm*—Ladas & Parry

(57) ABSTRACT

A polyhedron-like structural assembly comprises a plurality of polygonal frames installed in upright position on each of a pair of opposite sides of a structural assembly that is square-shaped in a plan view, a plurality of frames having H-shaped cross-sections and connecting the polygonal frames to form a plurality of triangular planes therebetween, a plurality of polygonal flat plates attached in the triangular planes to provide polyhedron-like upper walls and polyhedron-like side walls between the polygonal frames, and a joint disposed in the center of the assembly and having a plurality of arms formed to fit within the frames.

6 Claims, 9 Drawing Sheets

POLYHEDRAL FABRICATED STRUCTURE AND METHOD OF CONSTRUCTING THE SAME

TECHNICAL FIELD

This invention relates to a polyhedron-like structural assembly such as a garage and a greenhouse, particularly to a polyhedron-like structural assembly that can be simply enlarged by the same area, and a construction method thereof.

BACKGROUND ART

There was previously known a sphere-like building assembly having an approximately sphere-like roof in which sides of a plurality of polygonal panels were connected with one another (Japanese Utility Model Registration No. 3,004,346). Moreover, there was known a polyhedron-like building constituted by connecting sides of a plurality of triangular panels with one another (Japanese Utility Model Registration No. 3,004,347). Furthermore, there was known a dome-like building using pentagonal panels and hexagonal panels (Japanese Utility Model Registration No. 3,012,866).

All of the above-described previous polyhedron-like buildings are approximately circular in their plan views, so that it was difficult to connect the buildings with the same shape of them being held to construct a polyhedron-like building having a larger area.

Therefore, the above-described previous polyhedron-like buildings were not suited for being used as green houses, garages, residences and other kinds of houses, which were to be used by simply increasing or decreasing the areas thereof as necessary.

It is an object of this invention to propose a polyhedron-like structural assembly and a construction method, which assembly is a polyhedron-like structural assembly having a sufficient strength and a resistance to earthquake, can be simply assembled and disassembled with a low cost, and can be simply increased in the area thereof by the same area as the unit polyhedron-like structural assembly by connecting the unit polyhedron-like structural assembly one after another for being enlarged.

DISCLOSURE OF THE INVENTION

In order to achieve the above explained object, this invention is made so as to construct a polyhedron-like structural assembly by installing at least two polygonal frames in upright position with a specified space provided between the polygonal frames, providing connections between the polygonal frames by a plurality of frames, and along with this, attaching a plurality of polygonal flat plates to the polygonal frames and a plurality of the frames to thereby provide polyhedron-like upper walls and polyhedron-like side walls between the polygonal frames.

That is, in the unit polyhedron-like structural assembly according to this invention becoming square-shaped in a plan view, skeletons of at least two plains opposite to each other are constituted by polygonal frames installed in upright position on the ground. Therefore, by installing a new polygonal frame in upright position on the opposite side of the unit polyhedron-like structural assembly to the polygonal frame constituting a skeleton of one of the two opposed planes with a specified space provided therefrom, providing connections between the two polygonal frames by a plurality of frames, and attaching a plurality of polygonal flat plates to the polygonal frames and a plurality of the frames to thereby provide polyhedron-like upper walls and polyhedron-like side walls between the two polygonal frames, a new unit of the polyhedron-like structural assembly is to be connected to simply double the area of the polyhedron-like structural assembly.

Namely, a first polyhedron-like structural assembly proposed by the application concerned is a polyhedron-like structural assembly constituted by installing at least two polygonal frames in upright position with a specified space provided between the polygonal frames, providing connections between the polygonal frames by a plurality of frames, and along with this, attaching a plurality of polygonal flat plates to the polygonal frames and a plurality of the frames to thereby provide polyhedron-like upper walls and polyhedron-like side walls between the polygonal frames.

A first method of constituting a polyhedron-like structural assembly according to the application concerned for constituting the above-described polyhedron-like structural assembly comprises the following steps of (1) to (3):

(1) laying under the ground an anchor body at a position for supporting each of four corners of the polyhedron-like structural assembly being square-shaped in a plan view;

(2) standing at least two polygonal frames upright in being made opposite to each other to secure a bottom end of each of the polygonal frames to the anchor body; and (3) by using a plurality of frames, providing connections between the polygonal frames by a plurality of the frames while triangular frame works being formed each with three frames of a plurality of the frames, and along with this, providing polyhedron-like upper walls and polyhedron-like side walls between the polygonal frames, with triangular openings, each formed with three frames of a plurality of the frames, closed by using a plurality of triangular flat plates.

Moreover, a second polyhedron-like structural assembly proposed by the application concerned is a polyhedron-like structural assembly constituted by installing at least two polygonal frames in upright position with a specified space provided between the polygonal frames, providing connections between the polygonal frames by a plurality of frames and at least one joint used for connecting a plurality of the frames with one another, and along with this, attaching a plurality of polygonal flat plates to the polygonal frames and a plurality of the frames to thereby provide polyhedron-like upper walls and polyhedron-like side walls between the polygonal frames.

A second method of constituting a polyhedron-like structural assembly according to the application concerned for constituting the above-described second polyhedron-like structural assembly according to the application concerned comprises the following steps of (1), (2), and (3):

(1) laying under the ground an anchor body at a position for supporting each of four corners of the polyhedron-like structural assembly being square-shaped in a plan view;

(2) standing at least two polygonal frames upright in being made opposite to each other to secure a bottom end of each of the polygonal frames to the anchor body; and (3) using a plurality of frames and at least one joint used for connecting a plurality of the frames with one another, providing connections between the polygonal frames by a plurality of the frames while triangular frame works being formed each with three frames of a plurality of the frames, and along with this, providing polyhedron-like upper walls and polyhedron-like side walls between the polygonal frames, with triangular openings, each formed with three frames of a plurality of the frames, closed by using a plurality of triangular flat plates.

In the foregoing, by making the opposed polygonal frames to be constituted to have the same size and shape, the polygonal frames installed in upright position with a specified space provided between them necessitate only to be kept in being manufactured with specified sizes and shapes determined beforehand. Moreover, it is advantageous from the viewpoints of manufacturing cost and easiness in construction to make a plurality of the frames, providing connections between the polygonal frames installed in upright position with a specified space provided, and a plurality of polygonal flat plates, attached to the polygonal frames and a plurality of the frames to form upper walls and side walls of the polyhedron-like structural assembly, also necessitate only to be kept in being prepared only with specified sizes.

Therefore, from the viewpoints of manufacturing cost and easiness in construction, it is most advantageous that the unit polyhedron-like structural assembly is made square-shaped in a plan view and the polygonal frames installed in upright with a specified space provided between them are made to have sizes being equal to one another.

In the foregoing, it is necessary to use at least two of the polygonal frames installed in upright position with a specified space provided between them, and to install them in upright position so that skeletons of opposed two side walls of the polyhedron-like structural assembly, being square-shaped in a plan view of construction, are constituted by the two polygonal frames.

In this way, when two of the polygonal frames are used, next polyhedron-like structural assembly can be connected to the side wall for which the polygonal frame is used as the skeleton.

Moreover, it is also possible to use four polygonal frames so that each of them constitutes each skeleton of four side walls of the polyhedron-like structural assembly being square-shaped in a plan view of construction, and to install the four polygonal frames in upright position so that the skeletons of the four side walls of the polyhedron-like structural assembly being square-shaped in a plan view of construction are constituted by the four polygonal frames. This facilitates connections between the polygonal frames to be carried on by using a plurality of frames, and is preferable in obtaining more strength of the polyhedron-like structural assembly to be constructed.

When four polygonal frames are thus installed in upright position for being made as skeletons of the respective side walls of the polyhedron-like structural assembly being square-shaped in a plan view of construction, subsequent connections of polyhedron-like structural assemblies can be carried on to the respective side walls.

It is also possible to install three polygonal frames in upright position to constitute each skeleton of three side walls of a polyhedron-like structural assembly being square-shaped in a plan view of construction.

The polyhedron-like structural assembly according to this invention becomes an earthquake-resistant structure with high strength because, between the polygonal frames installed in upright with a specified space between them, by using a plurality of frames, connections are provided between the polygonal frames by a plurality of the frames while triangular frame works being formed each with three frames of a plurality of the frames, and along with this, polyhedron-like upper walls and polyhedron-like side walls are provided between the polygonal frames, with triangular openings, each formed with three frames of a plurality of the frames, closed by using a plurality of triangular flat plates, or, because, by using a plurality of frames and at least one joint used for connecting a plurality of the frames with one another, connections are provided between the polygonal frames by a plurality of the frames while triangular frame works being formed each with three frames of a plurality of the frames, and along with this, polyhedron-like upper walls and polyhedron-like side walls are provided between the polygonal frames, with triangular openings, each formed with three frames of a plurality of the frames, closed by using a plurality of triangular flat plates.

In addition, the polygonal frames with the standardized shapes and sizes, a plurality of frames with the standardized shapes and sizes, at least one joint used for connecting a plurality of the frames with one another, and a plurality of the triangular flat plates with the standardized shapes and sizes are only connected with known connection measures in this technical field such as bolts and nuts. This allows the polyhedron-like structural assembly to be significantly simply and efficiently constructed and disassembled.

In the foregoing, when the polyhedron-like structural assembly becomes a large one with a side of 7 m or above, in order to reinforce the structure, at least one joint, used for connecting a plurality of the frames with one another, are used at parts where a plurality of the frames, providing connections between the polygonal frames, are connected with and secured to one another, or at parts where side beams, upper beams and the like of the polygonal frame are connected with and secured to a plurality of the frames.

When the polyhedron-like structural assembly is a small one with a side of the order of 5 to 6 m, sufficient strength is exhibited without the above-described joint. Therefore, there is no need of using such a joint as described above.

BRIEF DESCRIPTION OF THE DRAWINGS

FIG. 4(*b*) is a cross sectional view illustrating an example of a connection structure of a part denoted by a reference character b in FIG. 1;

FIG. 8(*b*) is a cross sectional view illustrating an example of a connection structure of a part denoted by a reference character d in FIG. 5;

BEST MODE FOR CARRYING OUT THE INVENTION

Figure 1:
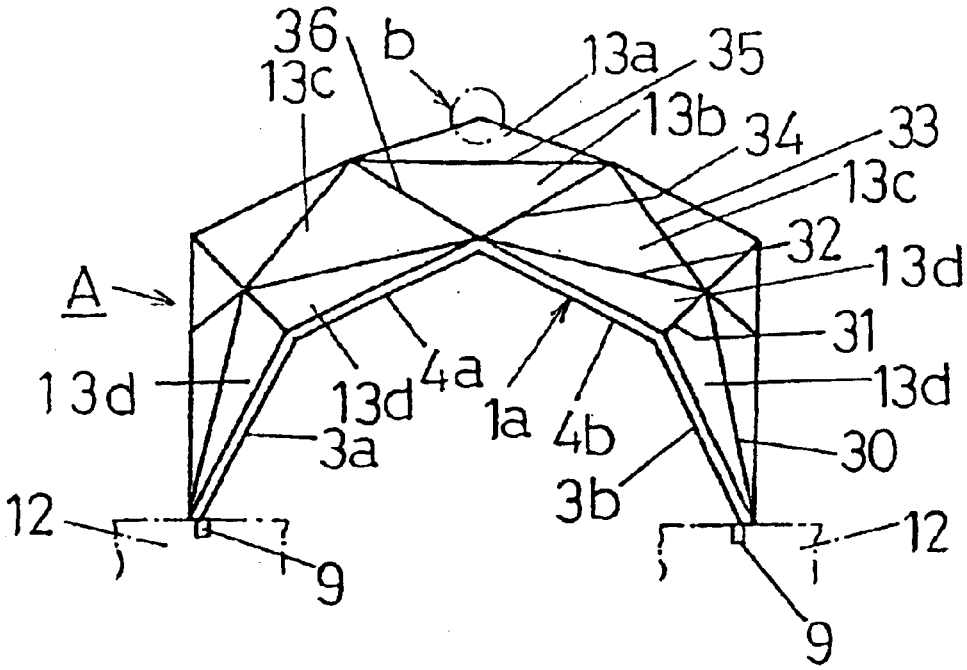
FIG. 1 is a front view of a first example of this invention.

In the following, best mode of this invention will be explained with reference to attached drawings.

Example 1

An example of the present invention of constructing a garage as a polyhedron-like structural assembly will be explained by using FIG. 1, FIG. 2, FIG. 3, FIG. 4(*a*), FIG. 4(*b*) and FIG. 9.

At a position for supporting each of four corners 7*a,* 7*b,* 7*c* and 7*d* (FIG. 2) of a garage A which is square-shaped in a plan view, an anchor base 9 is laid under a foundation concrete 12.

Polygonal frames 1*a*(FIG. 1), 1*b,* 1*c* and 1*d,* each constituted by connecting side beams 3*a* and 3*b,* and upper beams 4*a* and 4*b,* are used, which are stood upright in pairs with each pair made opposite to each other. A bottom end of each of the side beams 3*a* and 3*b* of each of the polygonal frames 1*a,* 1*b,* 1*c* and 1*d* is secured to each of the anchor bases 9. In FIG. 2, the polygonal frames 1*a* and 1*c* are stood upright in being made opposite to each other and those 1*b* and 1*d* are also stood upright in being made opposite to each other.

Subsequent to this, by using a plurality of frames, connections between the polygonal frames 1*a,* 1*b,* 1*c* and 1*d* are provided by a plurality of the frames while triangular frame works being formed each with three frames of a plurality of the frames. For example, a triangular frame work is formed with the side beam 3*b* and frames 30 and 31, a triangular frame work is formed with the upper beam 4*b,* the frame 31, and a frame 32, a triangular frame work is formed with the frame 32, and frames 33 and 34, and a triangular frame work is formed with the frame 34, and frames 35 and 36. In this way, the triangular frame works are formed from one to another to provide connections between the polygonal frames 1*a,* 1*b,* 1*c* and 1*d* by a plurality of the frames.

Thus, connections between the polygonal frames 1*a,* 1*b,* 1*c* and 1*d* are provided by a plurality of the frames while triangular frame works being formed. At the same time, polyhedron-like upper walls and polyhedron-like side walls are provided between the polygonal frames 1*a,* 1*b,* 1*c* and 1*d,* with the triangular frame works formed as described above closed by using a plurality of triangular flat plates.

For example, the triangular frame work formed with the side beam 3*b* and the frames 30 and 31, and the triangular frame work formed with the upper beam 4*b* and the frames 31 and 32 are closed by triangular flat plates 13*d* and 13*d,* respectively, the triangular frame work formed with the frames 32, 33 and 34 is closed by a triangular flat plate 13*c,* and the triangular frame work formed with the frames 34, 35 and 36 is closed by a triangular flat plate 13*b.*

In this way, the polyhedron-like upper walls and the polyhedron-like side walls are provided between the polygonal frames 1*a,* 1*b,* 1*c* and 1*d* to construct the garage A.

Figure 9:
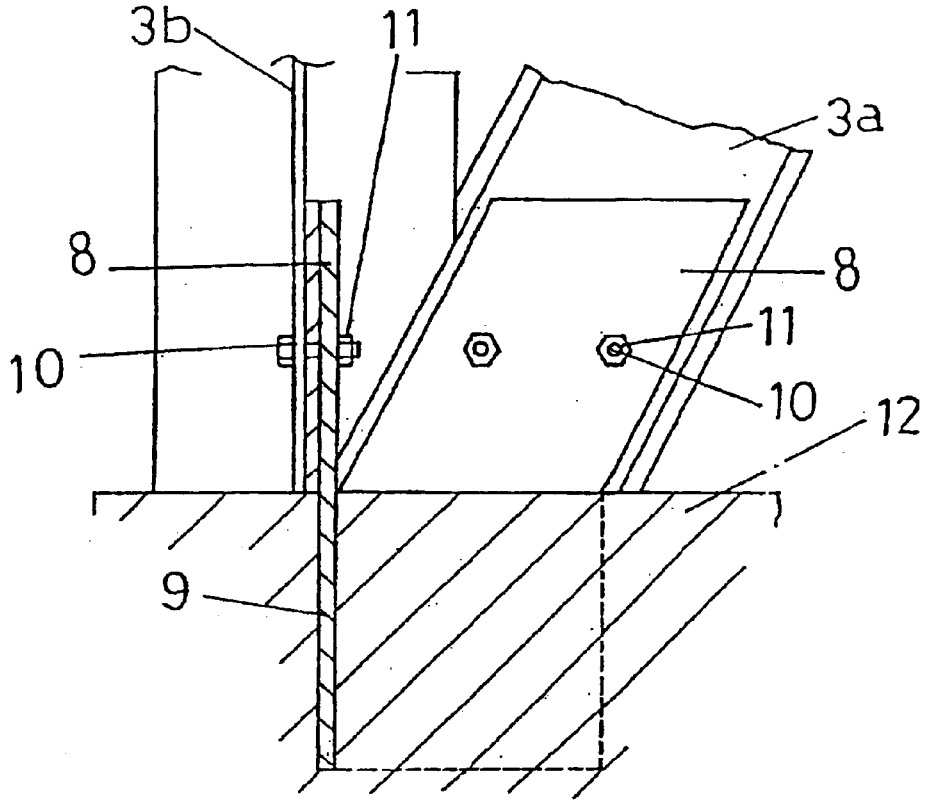
FIG. 9 is a cross sectional view illustrating a connection structure of a bottom end part of a polygonal frame and an anchor body.

In the above, in securing the bottom ends of the side beams 3*a* and 3*b* of each of the polygonal frames 1*a,* etc. to the anchor base 9, an installing structure can be employed as shown in FIG. 9 in which the bottom ends of the side beams 3*a,* etc. are secured to an upper base 8 of the anchor base 9 with a bolt 10 and a nut 11.

Figure 4A:
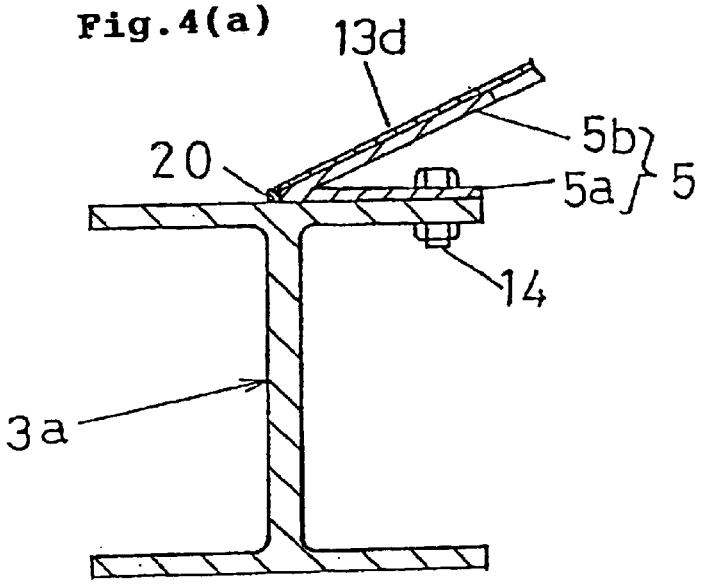
FIG. 4(*a*) is a cross sectional view illustrating a connection structure of a frame and a polygonal flat plate.
Figure 4B:
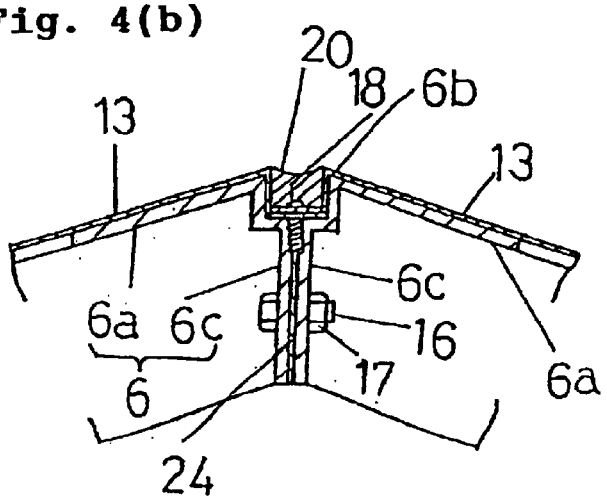

Moreover, attachment of the triangular flat plates to the side beams 3*a* and 3*b* of each of the polygonal frames 1*a,* etc., the upper beams 4*a* and 4*b,* and the frames 30, 31, 32, 33, 34 and 35, etc. can be carried out as shown in FIG. 4(*a*), for example.

By using a fixture 5 constituted of attachment pieces 5*a* and 5*b* provided at a specified angle to each other, the triangular flat plate can be attached with the attachment piece 5*a* connected to the side beam 3*a* by a bolt 14, with one edge of the triangular flat plate 13*d* attached to the other attachment piece 5*b* and sealed by a sealing medium 20.

Furthermore, at a part as a position represented by a reference character b in FIG. 1 and FIG. 2, a fixing structure can be employed as shown in FIG. 4(*b*), which will be explained below.

A fixture 6 is used in which, at a top end of an inclined piece 6*a,* there is provided a recess 6*b* connected with a drooping piece 6*c.* Two of the fixtures 6 are combined back to back with backs of the opposed drooping pieces 6*c* and 6*c* bonded through a double-sided adhesive tape 24, and are further tightened by a bolt 16 and a nut 17 to be fixed to each other. Subsequent to this, each of edges of triangular flat plates 13 and 13 is bent to be inserted in each of the recesses 6*b* and 6*b* and is fixed by a screw 18, and the recesses 6*b* and 6*b* are sealed with the sealing medium 20.

Figure 2:
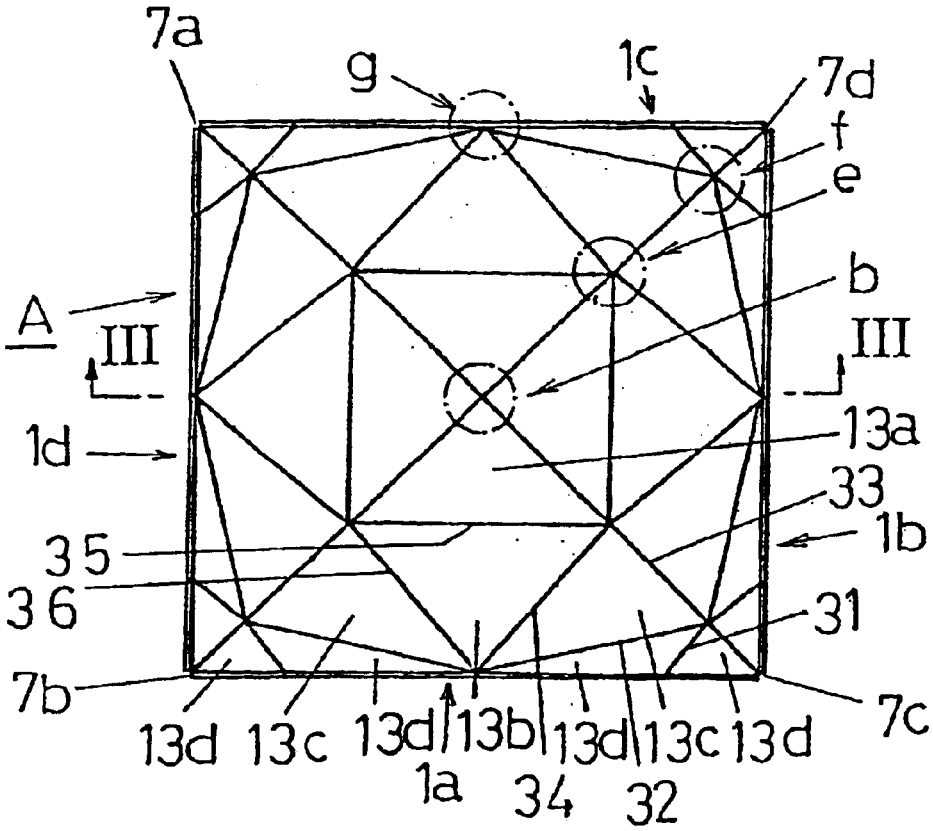
FIG. 2 is a plan view of a first example of this invention.

Securance of the bottom ends of the side beams 3*a* and 3*b* of the polygonal frames 1*a,* etc. to the anchor bases 9, attachment of the triangular flat plates to the side beams 3*a* and 3*b,* and upper beams 4*a* and 4*b* of the polygonal frames 1*a,* etc., and the frames 30, etc., and the fixing structure at a part as a position represented by a reference character b in FIG. 1 and FIG. 2, which are explained in the above example, are exemplifications besides which known connecting structures in this technical field can be employed.

Figure 14:
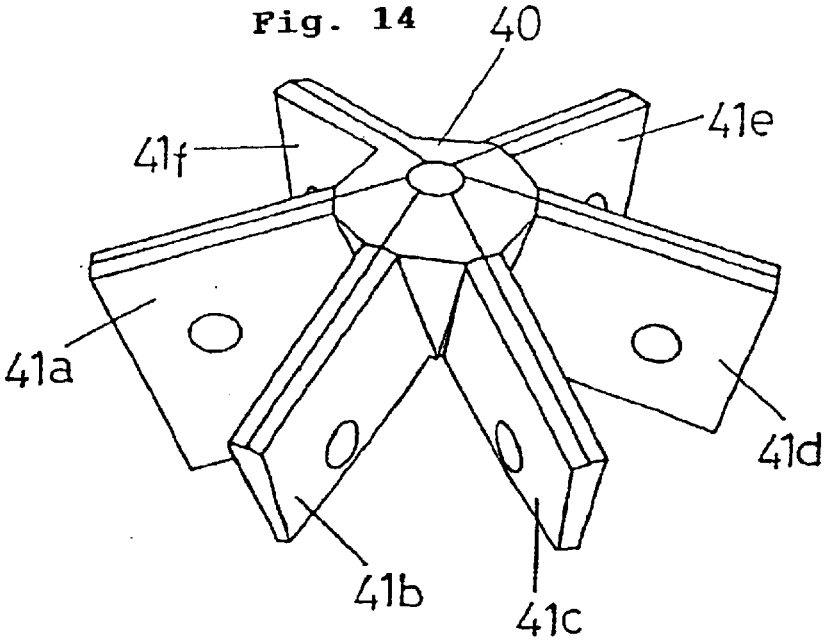
FIG. 14 is a perspective view of a joint used in this invention.
Figure 15:
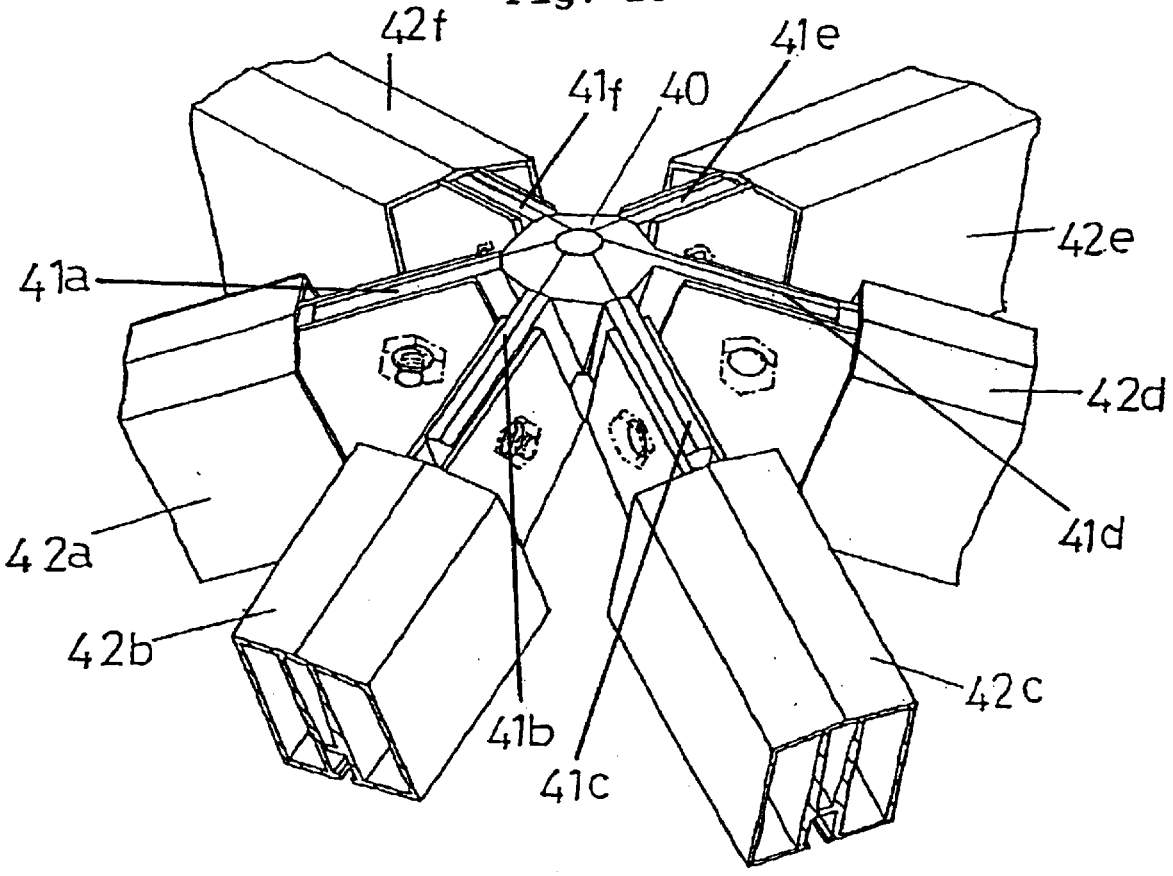
FIG. 15 is a perspective view illustrating a state in which the frames are connected to the joint shown in FIG. 14.

In FIG. 2, for connection in parts at positions as represented by reference characters e and f, a joint 40 can be used which is shown in FIG. 14. The joint 40 is provided with connection wings 41*a,* 41*b,* 41*c,* 41*d,* 41*e* and 41*f* in the directions from which the frames extend. The frames 42*a,* 42*b,* 42*c,* 42*d,* 42*e* and 42*f* extending toward the joint 40 are connected to the respective connection wings 41*a,* etc. by bolts and nuts as shown in FIG. 15.

When the polygonal frames 1*a,* etc. are relatively small, namely, when a space between the bottom ends of the side beams 3*a* and 3*b* is of the order of 5 to 6 m, for example, and a garage A is constructed with a size of the order of 5 to 6 m square, there is no necessity of using the joint 40. However, when the sizes of the polygonal frames 1*a,* etc. become relatively large, namely, when a space between the bottom ends of the side beams 3*a* and 3*b* becomes 7 m or above, for example, the joint 40 is desirably used for structurally strengthening the garage A.

As is explained in the foregoing, when the garage A is large-sized, it is preferable to prepare joints provided with four connection wings and joints provided with six connection wings, to use the joint provided with four connection wings for the fixing structure at the position represented by the reference character b in FIG. 1 and FIG. 2, and to use the joints provided with six connection wings for the fixing structures at the positions represented by the reference characters e and f in FIG. 2. Moreover, a joint is sometimes used for a fixing structure at a position represented by the reference character g in FIG. 2.

Figure 16A:
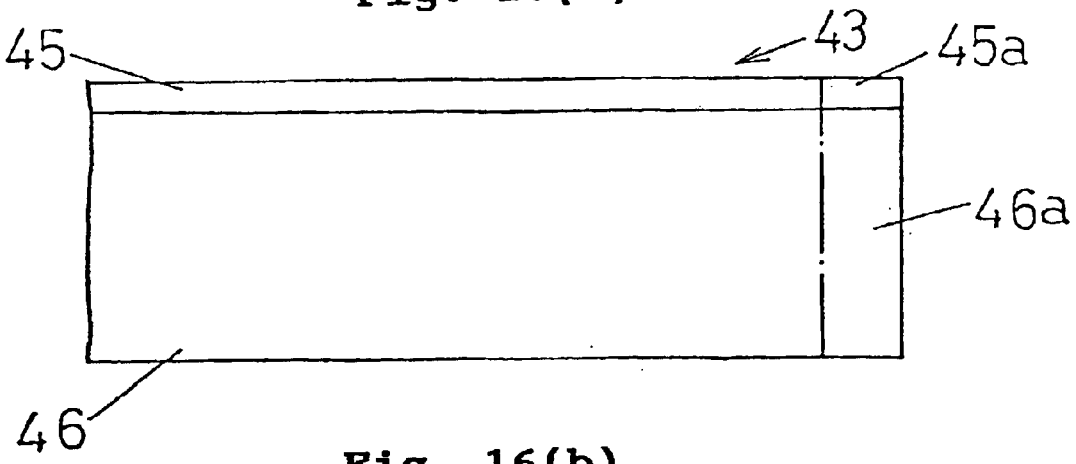
FIG. 16(*a*) is a front view of a section used in this invention, FIG. 16(*b*) is a side view of the section shown in FIG. 16(*a*) and FIG. 16(*c*) is a perspective view illustrating a state of the section shown in FIG. 16(*a*) exposing an end of an inside frame thereof.
Figure 16B:
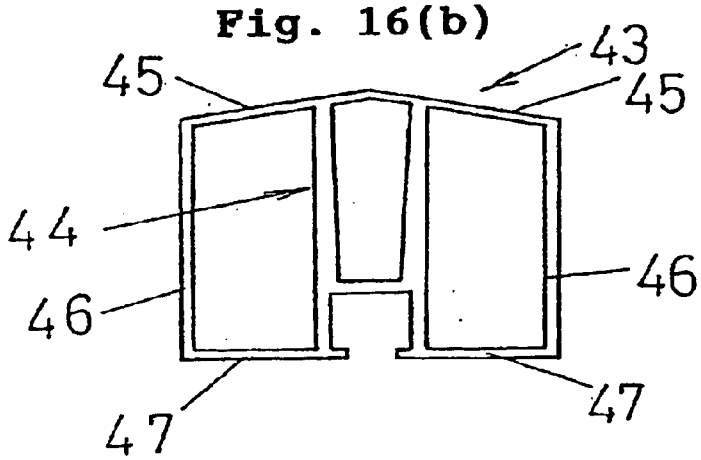
Figure 16C:
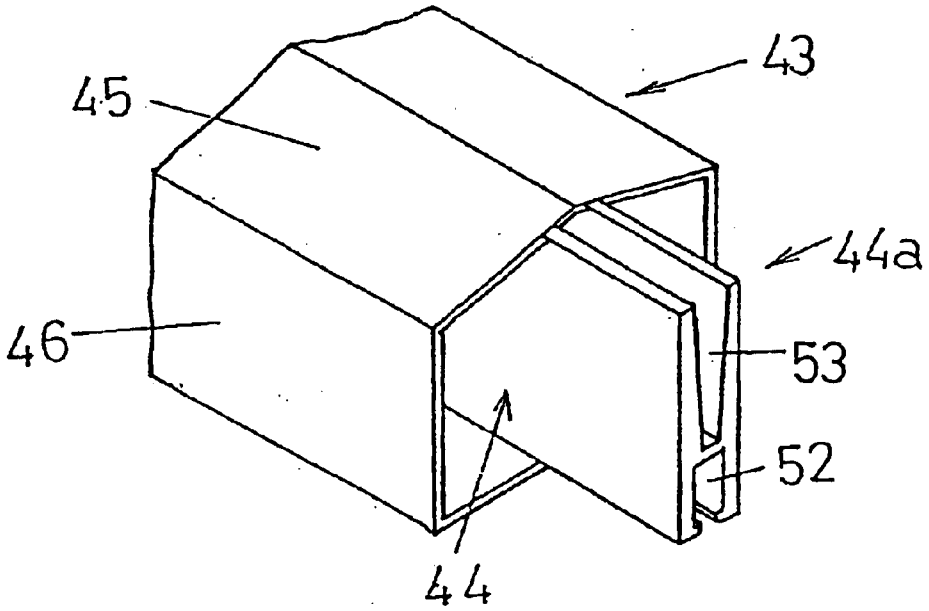

FIG. 16 presents a frame member 43 that can be used for the side beams 3*a* and 3*b,* and the upper beams 4*a* and 4*b* of the polygonal frames 1*a,* etc., and the frames 30, 31, 32, 33, 34, 35, 36, etc., which are employed for the polyhedron-like structural assembly according to this invention.

The frame member 43 is hollow tube-like, and, as shown in FIG. 16(*b*), is provided with an H-shaped inside frame 44 inside a hollow over the whole length of the frame member 43. By cutting away portions denoted by reference numerals 45*a* and 46*a* in FIG. 16(*a*) of upper walls 45, side walls 46, and bottom walls 47 of the frame member 43, an end portion 44*a* of the H-shaped inside frame 44 can be exposed to be used for being connected with and secured to a connection wings 41*a,* etc. of the joint 40. For example, as shown in FIG. 17, a connection wing 48 of the joint as is denoted by the reference numeral 40 in FIG. 14 can be inserted into the end portion 44*a* of the H-shaped inside frame 44 for being secured thereto by coupling respective through holes 50 and 51 of the end portion 44*a* and connection wing 48 with a bolt and a nut.

Figure 17:
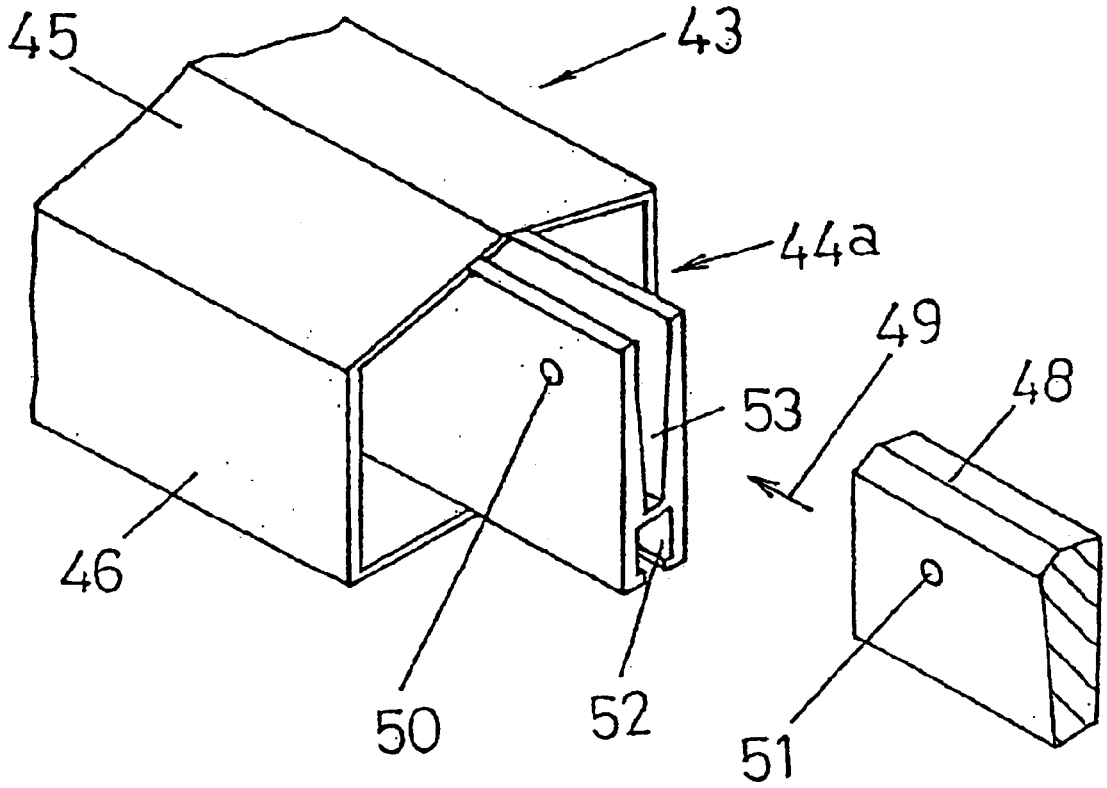
FIG. 17 is a perspective view illustrating a method of connecting the section used in this invention with another member.

A hole denoted by the reference numeral 52 in FIG. 16(*c*) and FIG. 17 extends over the whole length of the frame member 43 and is that for being used for wiring. Moreover, a hole 53 on the upper side of the H-shaped inside frame 44 is advantageously provided with a shape corresponding to the cross sectional shape of the connection wings 41*a,* etc. as shown in FIG. 17 in easiness of assembly and structural strength of a constructed structure.

The frame member 43 is, while being made hollow tube-like to become lightweight, provided with the H-shaped inside frame 44 inside over the whole length. Therefore, it exhibits sufficient strength required for a structural assembly. Furthermore, with the end portion 44*a* of the H-shaped inside frame 44 made exposed as described above, the frame member 43 can be efficiently connected with and secured to another member, for example, the connection wing of the joint shown in FIG. 14.

Furthermore, the frame member 43 made constituted as a section allows easy and low cost manufacturing of the side beams 3*a* and 3*b,* and the upper beams 4*a* and 4*b* of the polygonal frames 1*a,* etc., and the frames 30, 31, 32, 33, 34, 35 and 36, etc. having standardized sizes and shapes.

Figure 3:
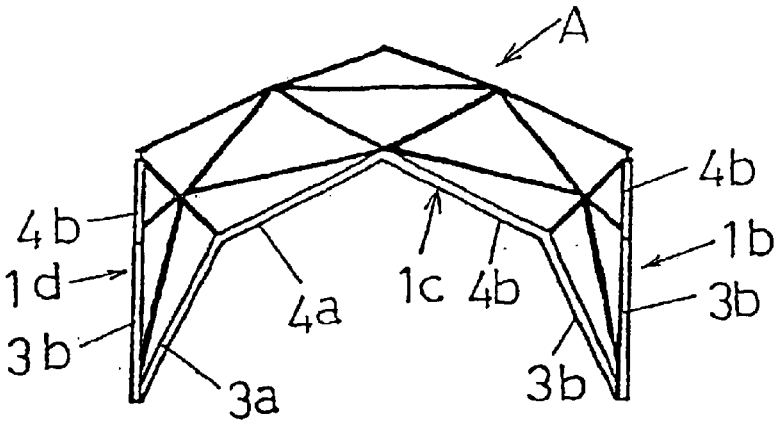
FIG. 3 is a cross sectional view taken along line I—I in FIG. 2.
Figure 10:
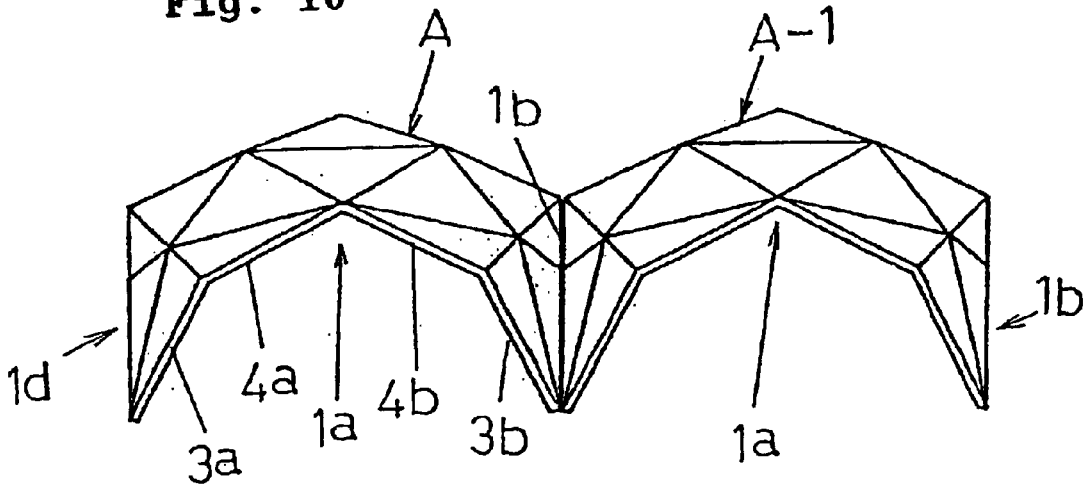
FIG. 10 is a front view illustrating a state in which two garages of the first example according to this invention are installed in being connected.
Figure 11:
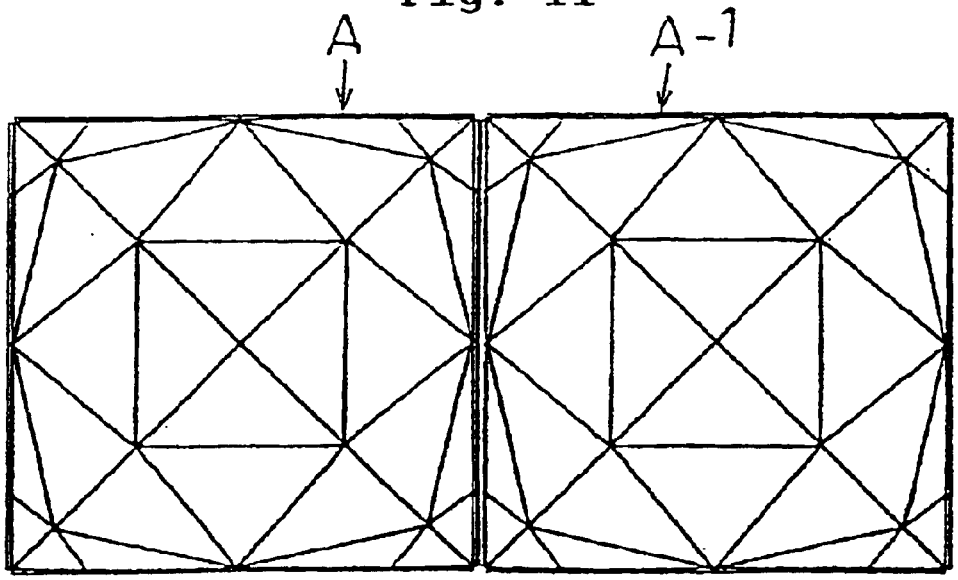
FIG. 11 is a plan view of the example shown in FIG. 10.

FIG. 10 and FIG. 11 are views showing a new garage A-1 connected to the polygonal frame 1*b* of the garage A shown in FIG. 1 to FIG. 3. In FIG. 10, method of constructing the garage A-1 newly installed on the right side is the same as that of constructing the garage A explained by using FIG. 1 to FIG. 3 and the like, so that the explanation thereof is omitted. Moreover, in this case, it is possible to connect the polygonal frame id of the garage A-1 on the right side of the polygonal frame 1*b* of the garage A in FIG. 10. In addition, it is also possible to provide a form in which the polygonal frame 1*b* of the garage A is shared by the garage A and the garage A-1 without using the polygonal frame 1*d* in the garage A-1.

In this way, the area of the structural assembly according to this invention can be easily made increased.

In addition, in FIG. 1 and FIG. 2, although the polygonal frame 1*a* is in a state of having an opening at the step in which the garage A and the garage A-1 have been constructed, a wall and further a door and a window can be also provided in the opening by using the above-explained frame members 43, necessary triangular flat plates, window members and door members, etc. In the same way, each of the openings constituted by the polygonal frames 1*b,* 1*c* and 1*d* can be made to have a wall provided with a door and a window.

As the triangular flat plates 13*c,* 13*d,* etc. used in the example, metal plates can be employed for the purpose of constructing the garage A.

However, depending on service objectives or uses of the constructed polyhedron-like structural assembly, there can be employed various kinds of polygonal flat plates such as concrete plates, synthetic resin plates, laminated plates each with a thermal insulation material laid between synthetic resin plates and glass plates.

Since the polygonal frames 1*a,* 1*b,* 1*c* and id used for constructing the garage A in the example have sizes equal to one another, the constructed garage A is presented as a square in a plan view as shown in FIG. 2. This requires the frames 30, etc. used for connecting the polygonal frames 1*a,* etc., and triangular flat plates 13*c,* etc. only to be prepared with specified standardized sizes. In addition, construction using such members can be simply and efficiently carried out by the standardized steps, which is advantageous from the viewpoints of manufacturing cost and easiness in construction.

Although the opposed polygonal frames 1*a* and 1*c* have the same size and shape, and similarly opposed polygonal frames 1*b* and 1*d* have the same size and shape, the polygonal frames 1*a* and 1*c* can be made to have different size and shape from the polygonal frames 1*b* and 1*d*. This makes the constructed garage A to be rectangular in a plan view. However, the frames 30, etc. used for connecting the polygonal frames 1*a,* etc. and the triangular flat plates 13*c,* etc. are similarly required to be prepared only with specified standardized sizes. Therefore, this does not fail to offer the advantage from the viewpoints of manufacturing cost and easiness in construction.

In the example, the polygonal frames 1*a,* etc. were those constituted by using the side beams 3*a* and 3*b,* and the upper beams 4*a* and 4*b* each polygonal frame having an opening formed in pentagonal in a front view as shown in FIG. 1. However, it is possible to use such a polygonal frame as to have an opening formed in hexagonal, heptagonal, or heptagonal in a front view by increasing the number of upper beams. Moreover, it is also possible to use a polygonal frame having an opening formed in quadrilateral in a front view by using side beams and an upper beam.

Example 2

An example of the this invention for constructing a green house B as a polyhedron-like structural assembly will be explained by using FIG. 5, FIG. 6, FIG. 7, FIG. 8(*a*), FIG. 8(*b*) and FIG. 9.

Figure 5:
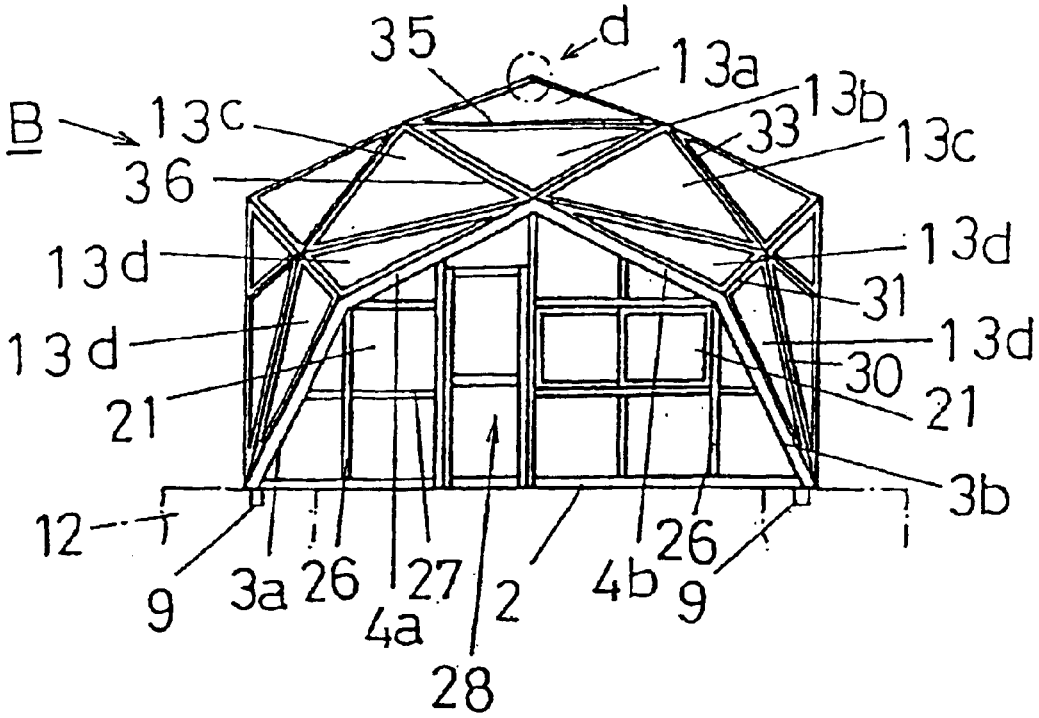
FIG. 5 is a front view of a second example of this invention.

The green house B in the example differs from the garage A in the example 1 in that each of the polygonal frames 1*a,* etc. is constituted of the side beams 3*a* and 3*b,* the upper beams 4*a* and 4*b* and a bottom beam 2. The bottom beam 2 is attached to a bottom end side of each of the side beams 3*a* and 3*b* as shown in FIG. 5. There are provided connections between the bottom beam 2, and the side beams 3*a* and 3*b*, and the upper beams 4*a* and 4*b* by frames 26 and 27 with glass plates 21 and a door 28 further attached thereto.

Moreover, as the triangular flat plates 13*c* and 13*d*, etc., glass plates are used instead of the metal plates in the example 1 in consideration for the use as the green house.

The constructing method of the green house B is the same as that in the example 1 except that a wall is provided by using the frames 26 and 27, and the glass plates 21, and a door 28 is provided in an opening constituted by the side beams 3*a* and 3*b*, the upper beams 4*a* and 4*b*, and the bottom beam 2 as shown in FIG. 5. Therefore, explanation thereof will be omitted.

For attachment of the triangular flat plates to the side beams 3*a* and 3*b*, and upper beams 4*a* and 4*b* of the polygonal frame 1*a*, etc., and the frame 30, and for a fixing structure at a part as a position represented by a reference character d in FIG. 5 and FIG. 6, what is explained below can be employed.

Figure 8A:
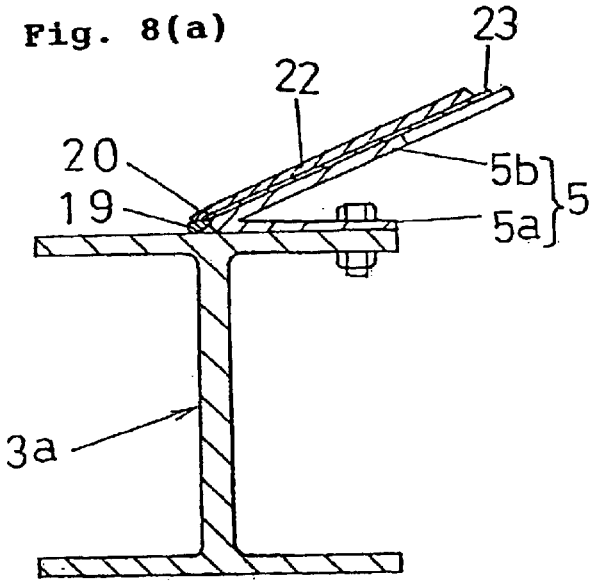
FIG. 8(*a*) is a cross sectional view illustrating another connection structure of a frame and a polygonal flat plate.
Figure 8B:
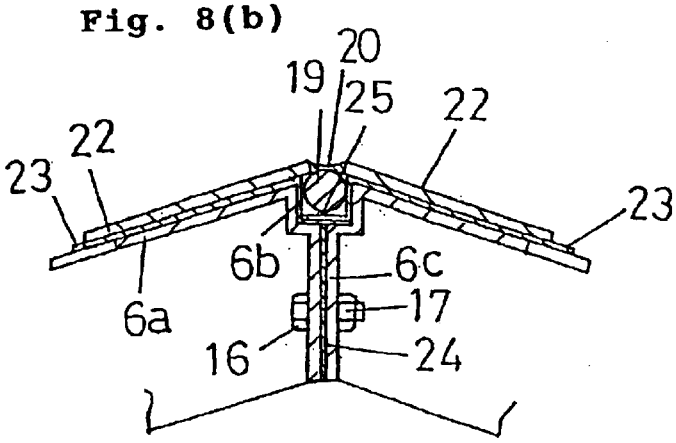

Attachment of the triangular flat plates to the side beams 3*a* and 3*b*, and upper beams 4*a* and 4*b* of the polygonal frame 1*a*, etc. is carried out, for example, as shown in FIG. 8(*a*), by using a fixture 5 constituted of attachment pieces 5*a* and 5*b* provided at a specified angle to each other, with the attachment piece 5*a* connected to the side beam 3*a* by a bolt, with one edge of a triangular glass plate 23 attached to the other attachment piece 5*b* to be secured thereto by a hold-down piece 22, and to be sealed by a backup material 19 and a sealing medium 20.

Figure 6:
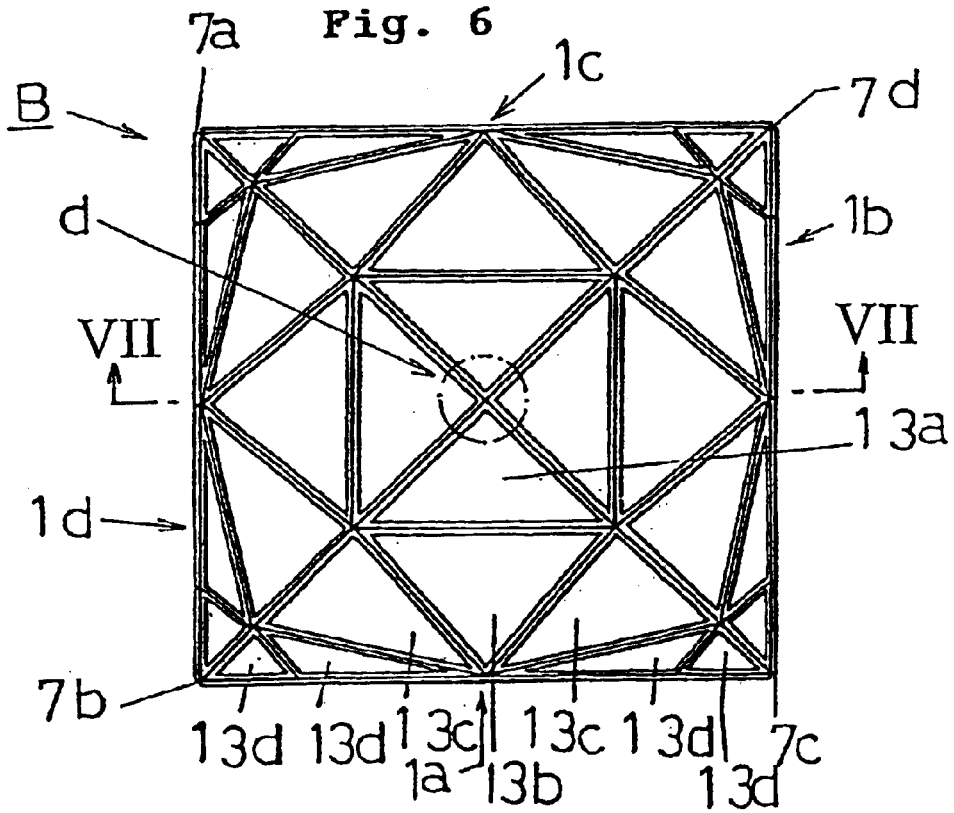
FIG. 6 is a plan view of a second example of this invention.

Furthermore, at a part as a position represented by a reference character d in FIG. 5 and FIG. 6, a fixing structure can be employed as shown in FIG. 8(*b*).

The structure is the same as the attachment structure shown in FIG. 4(*b*) in that it uses the fixture 6. In the structure, however, the hold-down piece 22 is further used to fix the glass plate 23, and the edge of the hold-down piece 22 is bent to be inserted in each of the recesses 6*b* and 6*b* and is fixed by a screw 25, and the recesses 6*b* and 6*b* are sealed with the backup material 19 and the sealing medium 20.

Figure 7:
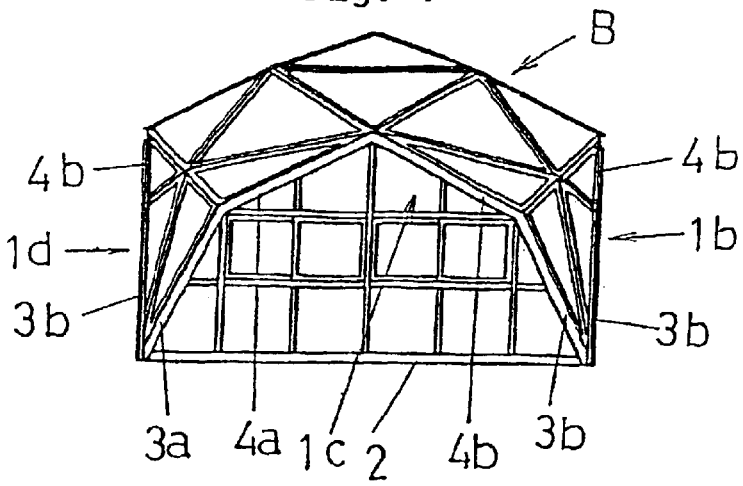
FIG. 7 is a cross sectional view taken along line II—II in FIG. 6.
Figure 12:
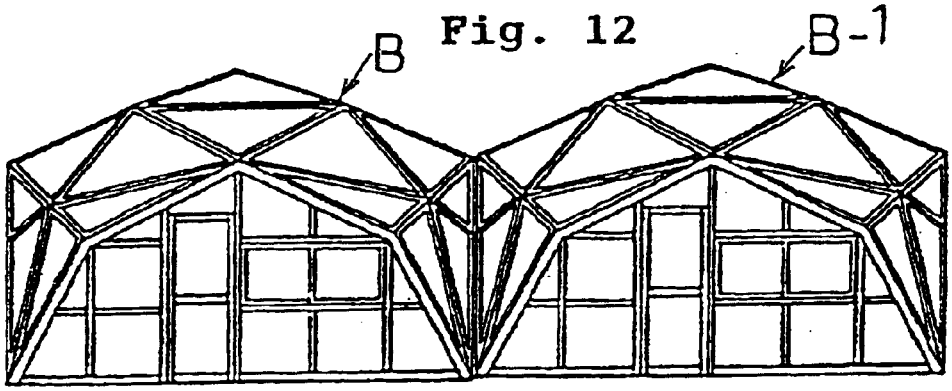
FIG. 12 is a front view illustrating a state in which two green houses of the second example according to this invention are installed in being connected.
Figure 13:
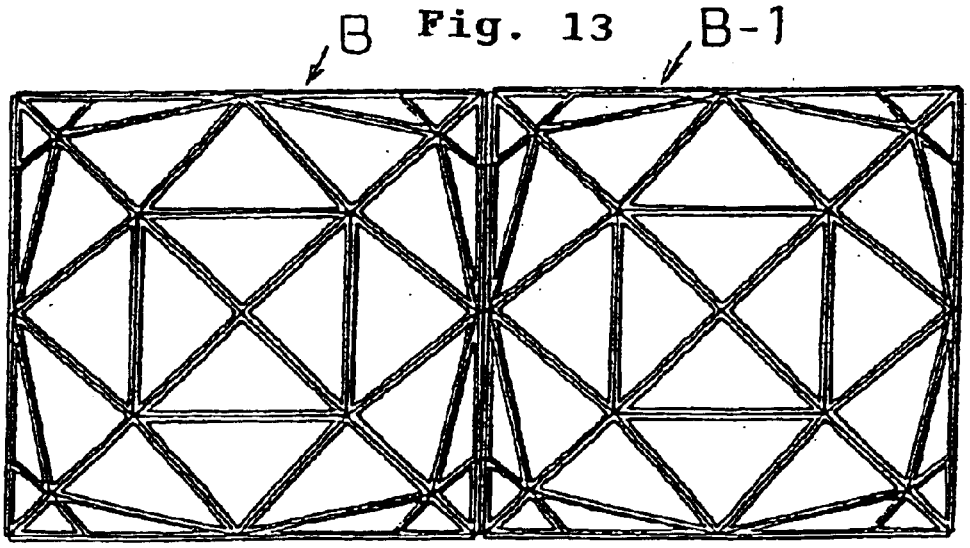
FIG. 13 is a plan view of the example shown in FIG. 12.

FIG. 12 and FIG. 13 are views showing a new green house B-1 connected to the polygonal frame 1*b* of the green house B shown in FIG. 5 to FIG. 7.

In the example, since the new green house B-1 is connected to the green house B on the right side thereof in FIG. 12, a green house can be constructed in rectangular as a whole in a plan view as represented in FIG. 12 and FIG. 13. In a state as shown in FIG. 13, by further constructing new green houses respectively below the green house B and the green house B-1, a green house can be easily constructed which is square-shaped in a plan view and has an area four times that of the green house B.

INDUSTRIAL APPLICABILITY

According to this invention, a polyhedron-like structural assembly can be provided which is a polyhedron-like structural assembly having a sufficient strength and a resistance to earthquake, can be simply assembled and disassembled with a low cost, and can simply increase or decrease the area thereof. Thus, the polyhedron-like structural assembly and a construction method thereof can be used for green houses, garages, residences, or houses of other kinds which are sometimes used with the area thereof simply increased or decreased as necessary.

What is claimed is:

1. A polyhedron-like structural assembly, comprising:

a plurality of polygonal frames installed in upright position on each of a pair of opposite sides of a structural assembly that is square-shaped in a plan view;

a plurality of frames having H-shaped cross-sections and connecting the polygonal frames to form a plurality of triangular planes therebetween;

a plurality of polygonal flat plates attached in the triangular planes to provide polyhedron-like upper walls and polyhedron-like side walls between the polygonal frames; and a joint disposed in the center of the assembly and having a plurality of arms formed to fit within the frames.

2. The polyhedron-like structural assembly as claimed in claim 1, wherein each of the plurality of frames is a frame member having a hollow tube-like body containing the H-shaped cross section therein.

3. The polyhedron-like structure assembly as claimed in claim 1, characterized in that each of the polygonal frames is comprised of connected side beams and upper beams.

4. The polyhedron-like structure assembly as claimed in claim 2 wherein an end portion of the hollow tube-like body of each frame is cut away to expose the H-shaped cross section therein to be connected with and secured to a connection wing of the joint.

5. A method of constructing a polyhedron-like structural assembly, comprising:

(1) laying under the ground an anchor body at a position for supporting each of four comers of the polyhedron-like structural assembly that is square-shaped in a plan view;

(2) standing a polygonal frame upright on each of a pair of opposite sides of the polyhedron-like structural assembly that is square-shaped in a plan view, standing polygonal frames upright on the other opposite sides, and securing a bottom end of each of the polygonal frames to the anchor body, each of the polygonal frames constituted by connecting side beams and upper beams;

(3) using a plurality of frames having H-shaped cross-sections to provide connections between the polygonal frames with the plurality of frames while forming triangular frameworks each with three frames among the plurality of frames, and along with this, closing triangular openings each formed by three frames among the plurality of frames using a plurality of triangular flat plates to provide polyhedron-like upper walls and polyhedron-like side walls between the polygonal frames; and (4) providing a joint in the center of the assembly, the joint having a plurality of arms formed to fit within the frames.

6. A method of constructing a polyhedron-like structural assembly as claimed in claim 5, wherein an end portion of each frame is cut away to expose the H-shaped cross section therein to be inserted onto a hollow tube-like body of the joint.

* * * * *